United States Patent [19]

Hatherly

[11] 4,194,953

[45] Mar. 25, 1980

[54] PROCESS FOR PRODUCING CHLORATE AND CHLORATE CELL CONSTRUCTION

[75] Inventor: David G. Hatherly, Mississauga, Canada

[73] Assignee: Erco Industries Limited, Islington, Canada

[21] Appl. No.: 12,593

[22] Filed: Feb. 16, 1979

[51] Int. Cl.[2] ..... C25B 1/26; C25B 9/00

[52] U.S. Cl. ..... 204/95; 204/269; 204/275; 204/289; 204/290 R

[58] Field of Search ..... 204/95, 269, 275, 289, 204/290 R

[56] References Cited

U.S. PATENT DOCUMENTS

| | | | |
|---|---|---|---|
| 3,824,172 | 7/1974 | Hodges | 204/95 |
| 3,972,796 | 8/1976 | Fröhler et al. | 204/95 |
| 4,046,653 | 9/1977 | De Nora et al. | 204/95 |
| 4,115,217 | 9/1978 | Larsson et al. | 204/95 |

*Primary Examiner*—R. L. Andrews
*Attorney, Agent, or Firm*—Sim & McBurney

[57] ABSTRACT

A sodium chlorate plant comprising a plurality of cell units linked in parallel flow relationship is described. The plant utilizes a single acidification, brine make up and heat exchange for liquor circulating therein. Each cell unit includes a plurality of individual chlorate cells linked in parallel-flow manner with a single reaction tank. The individual chlorate cells have a box-like body structure with lower inlet and upper outlet mild steel manifolds welded thereto. The cell box is cathodic on three sides and constructed of mild steel, the fourth side being an anode plate bolted to and insulated from the remainder of the cell box. Spaced interleaved vertical thin anode and cathode plates are located within the cell box and are welded into vertical slots formed in the respective backing plates to provide a plurality of parallel vertical electrolysis paths between the lower inlet and the upper outlet manifolds.

19 Claims, 7 Drawing Figures

PROCESS FOR PRODUCING CHLORATE AND CHLORATE CELL CONSTRUCTION

FIELD OF INVENTION

The present invention relates to the production of sodium chlorate, and, in particular, to chloratet cell constructions and multiple cell plants.

BACKGROUND OF THE INVENTION

Sodium chlorate is a valuable industrial chemical and is produced by the electrolysis of aqueous sodium chloride solutions. Various cell constructions and configurations are known for effecting the electrolysis.

SUMMARY OF INVENTION

The present invention provides sodium chlorate forming procedures and cell constructions which are particularly advantageous when compared with conventional operations.

In one aspect of the present invention, there is provided a sodium chlorate producing plant which comprises a plurality of cell units connected in parallel flow relationship with respect to each other and with a single acidification, brine make up and heat exchange.

The individual cell units comprise a plurality of chlorate cells connected in parallel flow relationship to each other and with a common reaction tank to which brine for electrolysis is fed and from which electrolyzed brine is removed. Temperature control for the reaction tank liquor and hence the electrolyzed brine is achieved by flow rate control in the reaction tank.

The individual cell construction provides a further aspect of the invention and comprises a box-like structure of welded construction on three sides with welded lower and upper inlet and outlet manifolds and a fourth side bolted to and insulated from the remainder of the box-like structure. Vertical thin anode and cathode plates interleave each other in spaced relation to provide a plurality of vertical electrolyte flow channels extending between the inlet and outlet for electrolysis of brine flowing therein. The electrode plates are welded into vertical slots formed in the respective backing plates.

DESCRIPTION OF PREFERRED EMBODIMENTS

Figure 1:
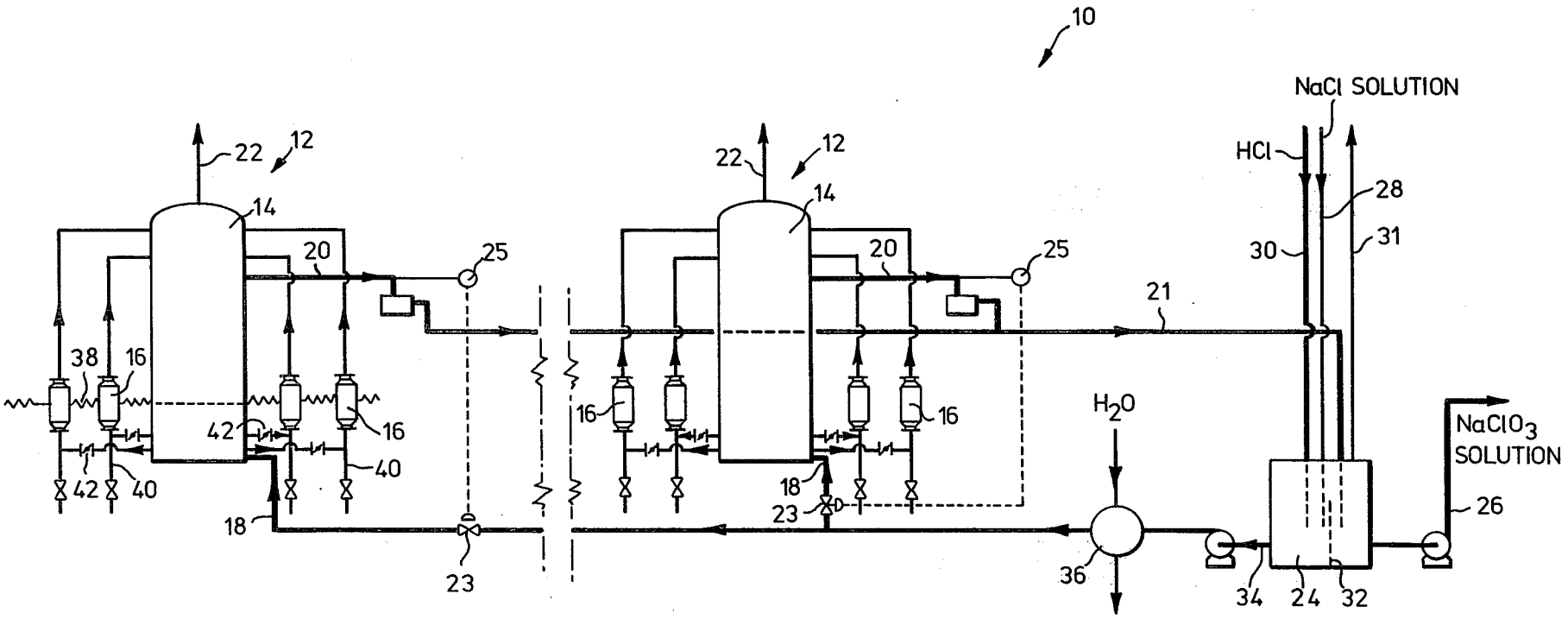
FIG. 1 is a schematic flow sheet of a multiple cell unit sodium chlorate producing plant.

Referring first to FIG. 1, there is illustrated therein a multicell unit sodium chlorate plant 10. The chlorate plant 10 consists of a plurality of individual sodium chlorate-producing units 12 connected in parallel flow relationship with each other. Two of the chlorate-producing units 12 are illustrated although more usually are used, depending on the production capacity desired, with each unit 12 conveniently being sized to produce, for example, about 1200 tons per year of sodium chlorate.

Each chlorate unit 12 includes a reactor tank 14 containing a body of liquor in which chlorate-forming reactions occur from the products of the electrolysis. A plurality of diaphragm-less electrolysis cells 16 is connected to the tank 14 in parallel liquor flow relationship with respect to each other to permit liquor for electrolysis to be forwarded from the tank 14 to each cell 16 and electrolyzed liquor from each cell 16 to recycle to the tank 14.

Each reactor tank 14 has an inlet pipe 18 for feeding thereto brine solution for electrolysis and an outlet pipe 20 for removal of sodium chlorate solution therefrom. A vent 22 for gaseous products of the electrolysis is provided for the reactor tank 14.

The flow rate of brine solution to each reactor tank 14 may be individually controlled by a manual valve 23 in accordance with the desired reactor tank liquor temperature. A sensor 25 may be provided in the sodium chlorate solution outlet line 20 to monitor the temperature of the solution, so that changes in flow rate to the reactor tank 14 may be made accordingly.

The sodium chlorate solution lines 20 combine to form a single product solution in line 21 which is fed to a single common mixing tank 24 for the plant. Sodium chlorate solution is removed from the tank 24 as the product of the plant 10 by line 26. Sodium chloride solution make up is fed to the mixing tank 24 by line 28 and hydrochloric acid required to acidify the solution to the required pH for electrolysis, for example, about 6.8, is fed to the mixing tank by line 30. Any sodium dichromate catalyst for the electrolysis reaction desired to be added may be included in the sodium chloride solution in feed line 28.

A vent line 31 may be provided for the mixing tank 24 for the removal of any residual entrained gases entering the mixing tank with the sodium chlorate solution in line 21.

The mixing tank 24 is separated internally into two chambers by a baffle 32 which extends upwardly therewithin to below the liquid level. The sodium chlorate solution in line 21 discharges to one chamber below the liquid level therein and the product removal line 26 communicates therewith while the sodium chloride solution and hydrochloric acid feed lines 28 and 30 discharge to the other chamber below the liquid level therein. In this way, contamination of the product chlorate stream 26 by the added materials is avoided while mixing of the added material with chlorate solution overflowing the baffle 32 is permitted.

The sodium chlorate solution enriched with added sodium chloride and acidified with hydrochloric acid (referred to herein as "brine solution"), is removed from the second chamber of the mixing tank 24 by line 34 and is passed through a heat exchanger 36 of any convenient construction. The brine solution then is fed in parallel to the plurality of units 12 by the respective feed lines 18.

The heat exchanger 36 cools the recirculating liquor in line 34 to the desired feed temperature, for example, about 40° C., while the heat generated in the cells 16 is removed as sensible heat in the overflow product lines 20. As indicated above, the temperature of this liquor may be controlled to a desired value, for example, in the range of about 60° to about 90° C., by suitable valved control of the brine flow to the cell units 12.

The cells 16 are electrically connected to each other by flexible electrical connectors 38 which permits relative movement of the cells 16, so that any desired relative location may be achieved.

Each cell 16 is provided with a valved drain line 40 and an individual flow control valve 42 which allows individual ones or all the cells to be cut off from liquid flow and to be drained for servicing.

The sodium chlorate plant 10, therefore, utilizes a single brine make up, acidification and heat exchange for a multiple number of sodium chlorate-producing units 12 operating in parallel relationship to each other, the number of such units 12 depending on their individual capacity and the overall production capacity of the plant 10. The mixing tank 24 and heat exchanger 36 are sized to meet the overall capacity of the plant 10.

The arrangement of cell units 12 and the construction thereof as illustrated in FIG. 1 has considerable benefits. Thus, each individual unit 12 produces a product stream of the desired chlorate concentration as a result of the action of the plurality of cells 16 acting in parallel. The product stream in each line 20 does not require further electrolysis prior to removal from the system. Each unit 12, therefore, is self-contained and hence individual operating problems may be isolated and remedied without interrupting operation of the other units.

By providing a single brine make up, acidification and heat exchange for the sodium chlorate plant 10, capital equipment costs associated with these items are minimized and uniformity of operating conditions throughout the plant 10 is achieved in simple manner.

By providing a plurality of cells 16 in parallel relationship with a single reaction tank 14 in each unit 12, the effect of individual variations in operating characteristics of the cells on product quality is minimized and lesser equipment costs are realized than in the case if each cell 16 has its own reaction tank 14.

Flexible electrical connectors provided between the individual cells 16 permit considerable variation in the relative positioning of the cells 16 with respect to each other and avoids any difficulties associated with connecting the cells in fixed relationship in a bank.

Turning now to FIGS. 2 to 6, there is illustrated therein the details of construction of a chlorate cell which represents the preferred construction for the chlorate cells 16 of FIG. 1. A chlorate cell 16 has a generally enclosed box-like structure shown in exploded form in FIG. 2 with a lower liquid inlet manifold 50 and an upper liquid outlet manifold 52. The inlet and outlet manifolds 50 and 52, which may be cathodically protected, are integrally assembled by welding with an upright rectangular cathode end plate 54. The inlet and outlet manifolds 50 and 52 and the cathode end plate are constructed of mild steel. From the end plate 54 project perpendicularly thereto in generally vertical alignment a plurality of thin steel cathode plates 56.

The inlet and outlet manifolds 50 and 52 close the top and bottom of the unit and the cathode end plate 54 and the two outermost cathode plates 56 enclose three sides of the cell box. The fourth side of the cell box is occupied by an anode end plate, as described below.

The provision of mild steel inlet and outlet manifolds enable ready assembly of these items with the remainder of the cell box by welding, in place of bolts or other fastening means, which otherwise would be necessary if a corrosion-resistant polymeric material were used as the material of construction.

Similarly the utilization of electrodes to enclose sides of the cell simplifies construction of the cell, in that it avoids the necessity to use bolting and sealing gaskets.

The cathode end plate 54 is comprised of an inner steel sheet 58 explosively bonded to an outer copper or aluminum sheet 60. This two-part structure facilitates electrical connections to the cell 16 and minimizes voltage drop along inter-cell connectors.

The steel sheet 58 has a plurality of vertical slot-like recesses 62 formed therein each receiving the inner end of one of the thin cathode plates 56 in interference snug fit relation thereto and the cathode plates 56 are welded therein.

The two outermost cathode plates 56 which enclose the sides of the cell 16 are welded to peripheral frame members 64 to which the inlet and outlet manifolds 50 and 52 also are welded. Outer protective and strengthening plates 65 are welded to the frame members 64 externally of the outermost plates 56.

An upright rectangular anode end plate 66 is provided parallel to the cathode end plate 54 enclosing the fourth side of the cell 16. The anode end plate 66 has a plurality of vertically-aligned thin anode plates 68 projecting therefrom parallel to and interleaved with the cathode plates 56. The anode end plate 66 is comprised of an inner titanium sheet 70 explosively bonded to an outer copper or aluminum sheet 72 to facilitate electrical connection to the anode plate and minimize voltage drop along inter-cell connectors. The titanium sheet 70 has a plurality of vertical slot-like recesses 74 formed therein each receiving the inner end of one of the thin anode plates 68 in interference snug fit relation thereto and the anode plates 68 are welded therein. The thin anode plates 68 preferably are constructed of titanium with an electrically-conducting surface thereon, for example, a platinum group metal or alloy thereto or other electrically-conducting coating, such as, a platinum group metal oxide.

The thin anode plates 68 interleave with the thin cathode plates 56 in the assembled cell box to define a plurality of parallel vertical flow channels 75 therebetween to permit electrolyte to pass upwardly through the cell 16 between the electrode plates from the inlet manifold 50 to the outlet manifold 52. Spacer elements 76 are provided to maintain the electrode plates 56 and 68 in desired spaced relation to each other.

As seen in FIGS. 2 to 6, the interleaved electrodes occupy all the space between the side walls of the cell box and separate the space into the vertical flow channels 75, so that the cell box has a very high electrolyzing capacity.

The utilization of the vertical slots or recesses in the anode and cathode end plates to receive the electrode plates, the welding therein to assemble the respective electrode plates with the respective backing plates and the utilization of spacer elements 76 permits maximum cell box space utilization, since the electrode plates may be made very thin, for example, about 1/16 to about $\frac{1}{8}$ inch in thickness.

This arrangement contrasts markedly with prior systems wherein anode plates are bolted to the end plate which limits the number of anode plates which can be mounted thereon and also increases the thickness of the cathode plates, typically to about $\frac{1}{2}$ inch, to maintain the desired electrode gap, generally about 1/16 to about ⅛ inch.

An additional advantage of the welded anode plate construction is that the potentially high voltage drop between the bolted anode plate and the backing plate is eliminated.

The thin cathode plates which may be utilized in the cell 16 also permit much smaller and lighter cells for the same capacity to be constructed and the generally flexible nature of the cathodes permits ready assembly of the anode plate bundle with the cathode plate bundle, in contrast to the comparatively inflexible cathode bundle when thicker cathode plates are used in the bolted anode construction.

Figures 2, 3:
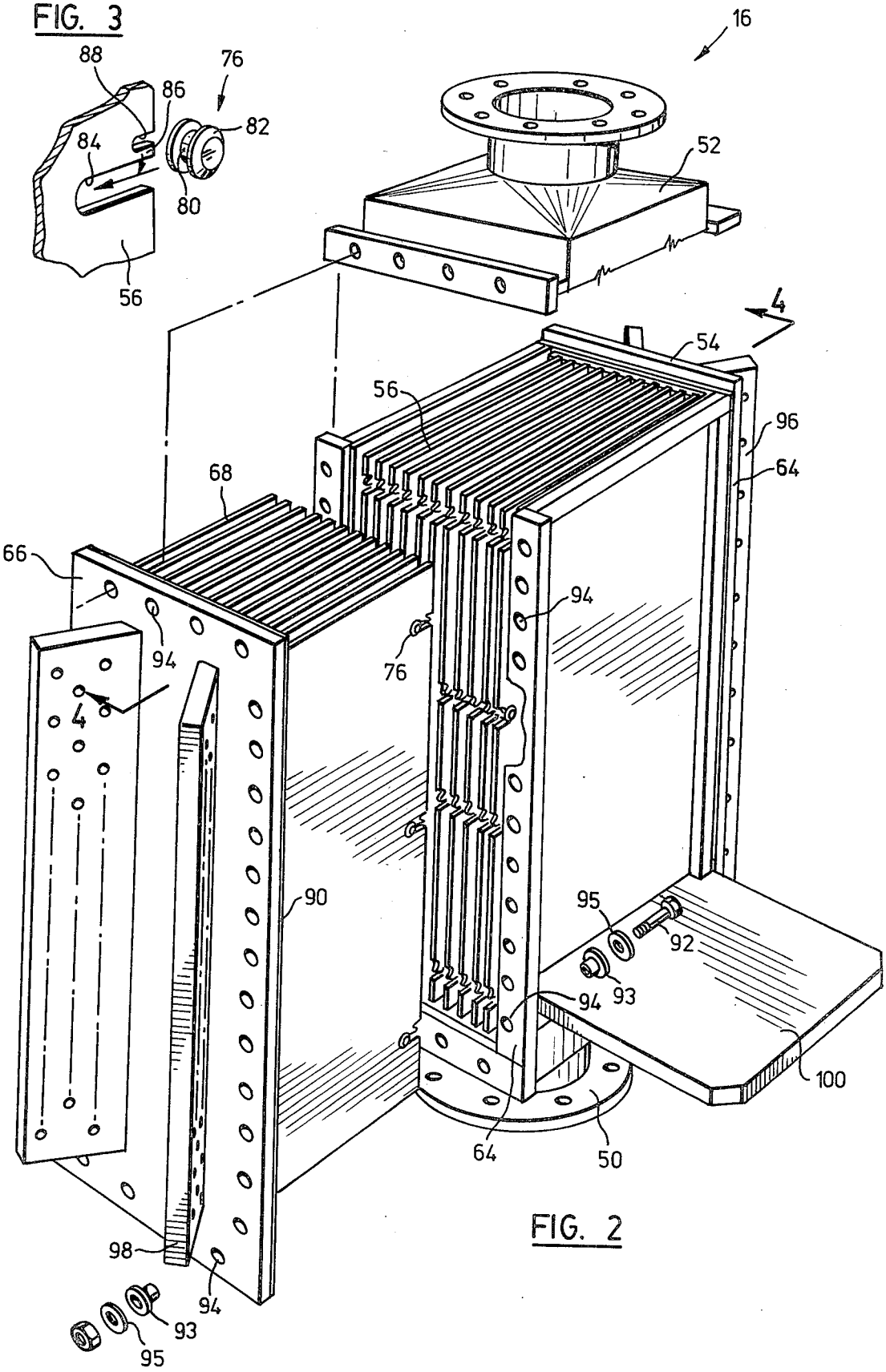
FIG. 2 is an exploded perspective view of a single chlorate cell provided in accordance with one embodiment of the invention.
FIG. 3 is a close up perspective view of an electrode plate spacer element used in the chlorate cell of FIG. 2 and the assembly thereof with an electrode plate.
Figure 4:
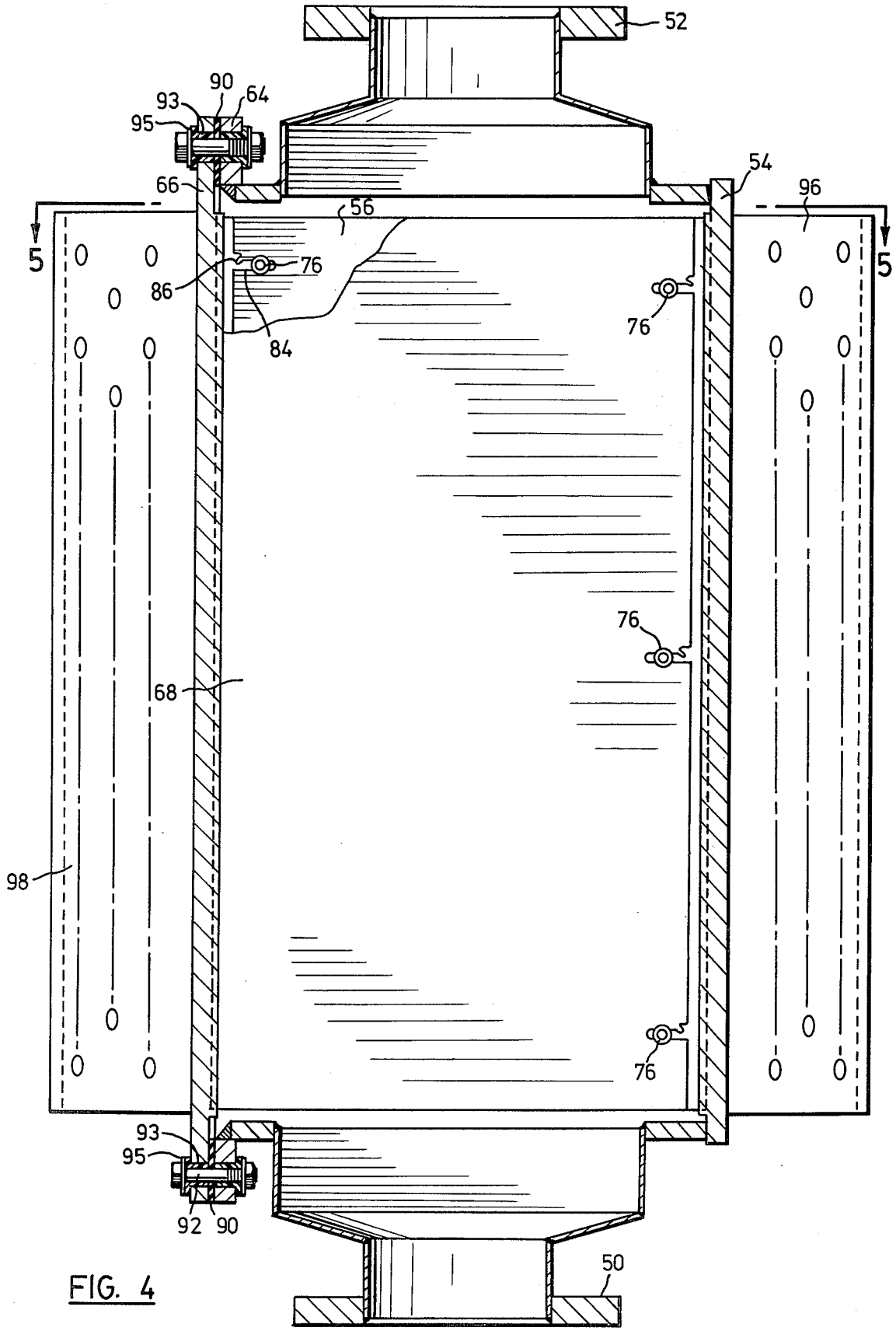
FIG. 4 is a sectional view of the chlorate cell taken on line 4—4 of FIG. 2.
Figure 5:
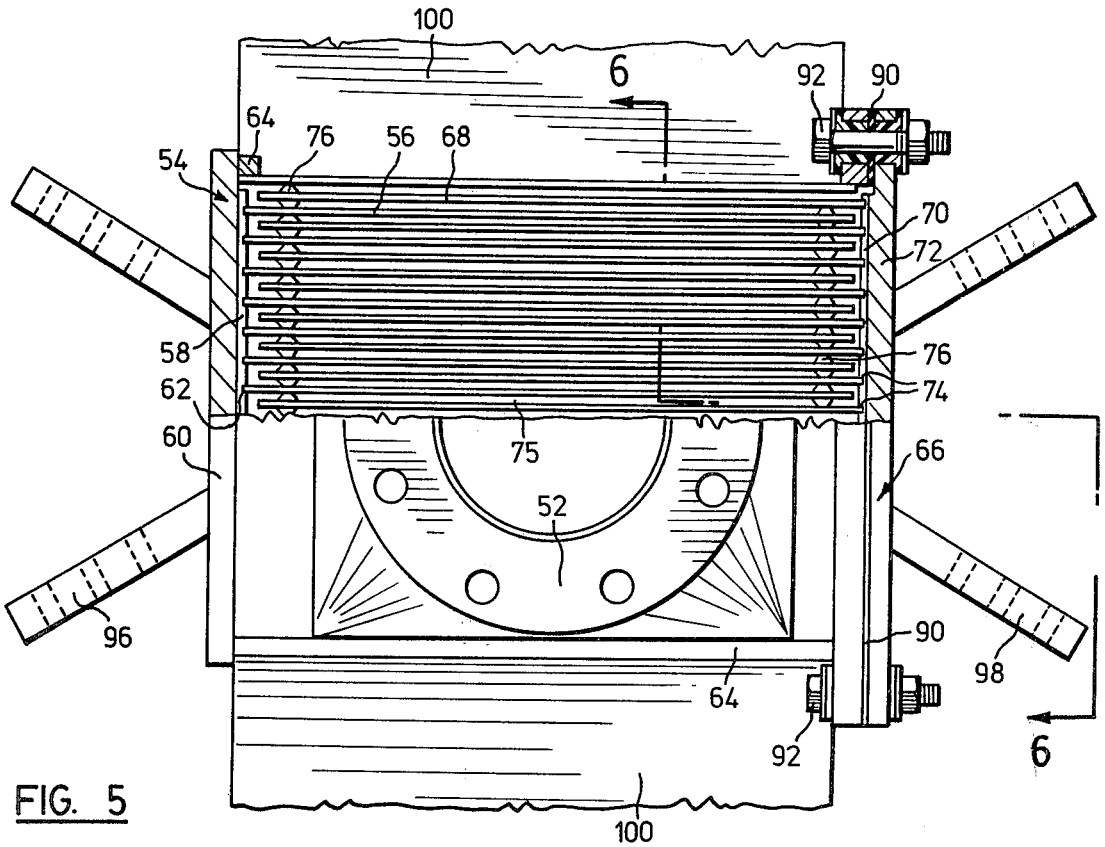
FIG. 5 is a sectional view taken on line 5—5 of FIG. 4.
Figure 6:
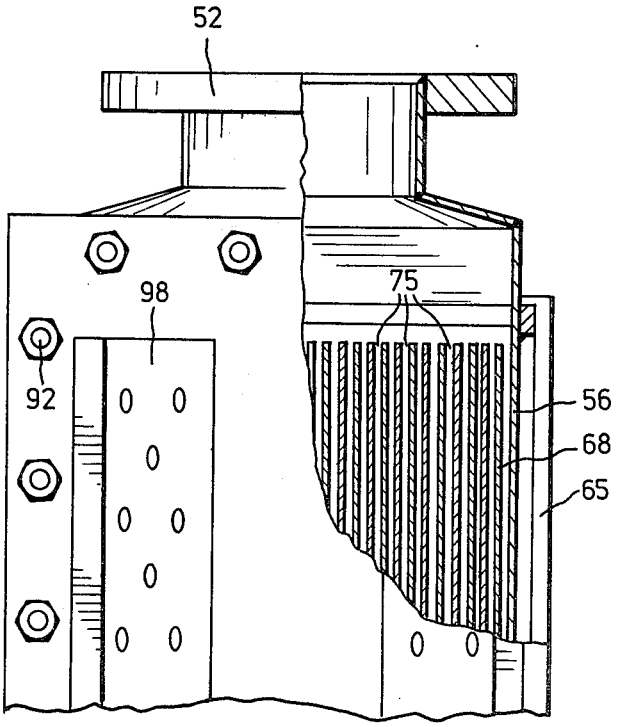
FIG. 6 is a sectional view taken on line 6—6 of FIG. 5.

As may be seen from the detail drawing of FIG. 3, the spacer elements 76 utilized to maintain the electrode plates in their desired relative prositions comprise an integrally-formed one-piece member 78 constructed of non-conductive corrosion-resistant material, such as, polytetrafluoroethylene, the member 78 has a short cylindrical portion 80 dimensioned to just exceed the thickness of the electrode plate 56 or 68 and two bevel-edged head portions 82 of larger diameter than the cylindrical portion 80 located one at each end of the cylindrical portion 80.

The spacer elements 76 are mounted at the edge of the electrode plate 56 or 68 remote from the end plates 54 or 66 in any desired number to ensure proper spacing, by providing an elongate slot 84 extending inwardly from the electrode plate edge, preferably perpendicularly thereto, with a vertical dimension slightly larger than the diameter of the cylindrical portion 80, sliding the spacer element 76 into the slot 84, with the flat inner faces of the domed portions 82 engaging the outer surfaces of the electrode plate, and closing off the slot 84 to prevent removal of the spacer element 76 by turning downwardly and inwardly a tang 86 formed between a short slot 88 located generally parallel to slot 84.

A plurality of such spacer elements 76 is provided for each electrode plate, with the number depending on the dimensions of the electrode plates. Usually at least three spacer elements 76 are provided one near the top of the electrode sheet, another near the bottom and one approximately in the middle.

Spacer elements have previously been used in electrolytic cells but have generally involved two parts which are press-fitted or otherwise joined together through openings formed in the cell plate. These two-part spacers have generally been found to be unsatisfactory in that they tend to come apart during cell assembly and thereby become ineffective.

The use of the integrally-formed one piece spacer elements 76 overcomes this prior art problem and provide reliable long-lasting electrode spacing.

The spacer elements 76 constitute the invention of copending U.K. patent application Ser. No. 38671/78 (E150) filed Sept. 29, 1978.

An insulating and sealing gasket 90 is provided around the perimeter of the anode end plate 66 to electrically insulate the same from abutting cathodic frame members 64 in the assembled cell box. The anode plate 66 is mounted to the frame members 64 by suitably insulated nuts and bolts 92 extending through aligned openings 94 in the respective abutting elements.

The nut and bolt combination 92 utilizes sleeves 93 and washers 95 of sufficient strength to withstand the jointing pressure necessary to ensure a fluid tight seal around the gasket 90. Suitable materials of construction include melamine for the washers 95 and polypropylene for the sleeves 93.

Electrical lead connector plates 96 are welded to the outer surface of the cathode end plate 54 while similar electrical lead connector plates 98 are welded to the outer surface of the anode end plate 66. The connector plates 96 and 98 are connected to suitable electrical power leads, not shown.

Cell box mounting plates 100 extend horizontally from the cell box side walls to permit the cell box to be mounted in upright position in a suitable frame.

Figure 7:
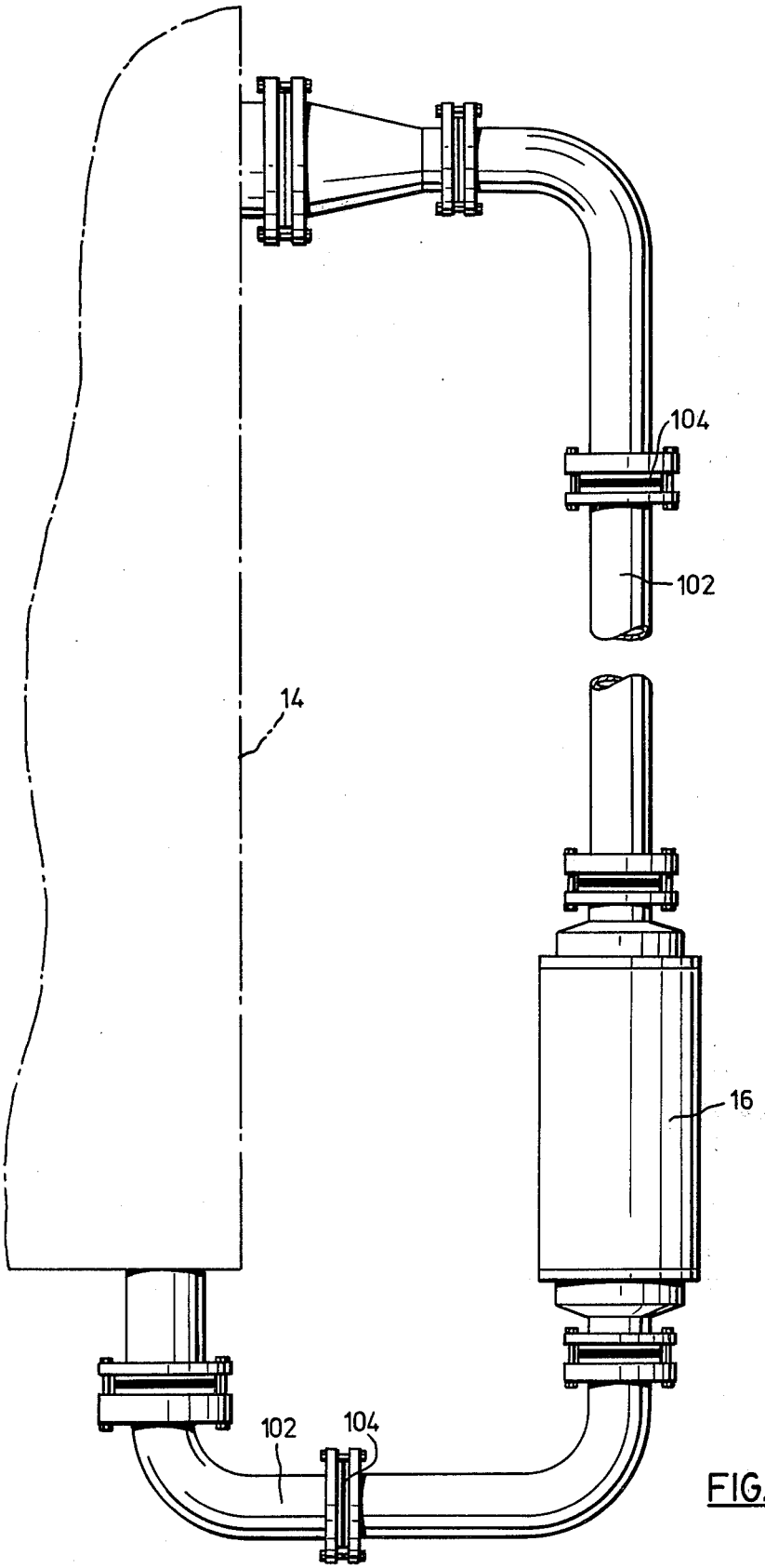
FIG. 7 is an elevational view illustrating piping connections from one cell unit to the reaction tank.

Turning now to FIG. 7, there is shown therein the pipe connections connecting the cell 16 to the tank 14. Pipe elements 102 constructed of corrosion resistant but electrically-conducting material, such as, titanium, are provided in short sections which are electrically insulated from each other by suitable insulating assemblies 104 to minimize current leakage along those pipes and corrosion of the pipes resulting from a potential difference between the pipes and the liquor flowing therethrough.

The diameter of the inlet and outlet pipes 102 generally are much smaller than the pipes used in other cell systems of the upwardly flow type to result in a lower flow rate of liquor across the electrode surfaces. Typical diameter values are about 4 inches for a 35,000-amp cell as opposed to the prior art, about 8 to 10 inches and flow rates are about 10 cm/sec as opposed to the prior art, about 40 cm/sec.

It has been found that this comparatively low liquor flow rate has a negligible effect on oxygen evolution and inefficiency and gas-lift is sized on flow considerations rather than on retention volume. The much smaller diameter pipes results in a capital cost saving and a decreased current leakage.

SUMMARY OF DISCLOSURE

The present invention, therefore, provides a sodium chlorate producing system having certain benefits and a unique cell unit for use therein. Modifications are possible within the scope of the invention.

What I claim is:

1. A method for the production of sodium chlorate, which comprises feeding sodium chloride solution to be electrolyzed in parallel from a single make-up source to a plurality of sodium chlorate-producing zones, removing sodium chlorate solution in parallel from said plurality of sodium chlorate-producing zones to form a single sodium chlorate stream, each of said sodium chlorate-producing zones comprising a single reaction zone to which said sodium chloride solution to be electrolyzed is fed and from which said sodium chlorate solution is removed, and a plurality of diaphragmless electrolysis zones each connected to said single reaction zone for flow of liquor for electrolysis rich in sodium chloride from said reaction zone into the respective electrolysis zone and for flow of electrolyzed liquor lean in sodium chloride from the respective electrolysis zone into said reaction zone, establishing said single make-up source of sodium chloride solution by adding fresh sodium chloride solution to part of said single sodium chlorate stream, adjusting the pH of the resulting mixed solution to a value required for electrolysis and subjecting the pH adjusted mixed solution to heat exchange to provide said single make-up source with the required temperature, and recovering the remainder of said single sodium chlorate stream as the product of said method.

2. The method of claim 1 wherein the flow rate of sodium chloride to each of said sodium chlorate-producing zones is individually controlled.

3. The method of claim 2 including sensing the temperature of the sodium chlorate solution leaving each of said sodium chlorate-producing zones and adjusting the flow rate of sodium chloride solution to the respective sodium chlorate-producing zone, as required, to maintain a desired temperature in said sensed solution.

4. The method of claim 3 wherein said desired temperature is in the range of about 60° to about 90° C.

5. The method of claim 1, 2, 3 or 4 wherein each of said diaphragmless electrolysis zones includes a plurality of parallel vertically-directed liquid flow paths across which electric current flows transverse to the liquid flow to electrolyze the liquid flowing therein, said flow paths extending from a lower inlet to said electrolysis zone to an upper outlet from said electrolysis zone.

6. The method of claim 5 wherein said diaphragmless electrolysis zones are electrically connected in series but otherwise are physically separate from each other.

7. An electrolysis plant for the production of sodium chlorate solution, comprising a plurality of electrolysis units, each of said electrolysis units comprising a reaction tank, first liquid inlet means for feeding sodium chloride solution to be electrolyzed to said tank, first liquid outlet means for removing sodium chlorate product solution from said tank, and a plurality of individual electrolysis cells, each cell having a plurality of anode and cathode electrodes located therein in interleaved manner to define upwardly-directed parallel electrolysis channels therebetween extending between a lower inlet of said cell communicating with the reaction tank through second liquid outlet means of said tank and an upper outlet of said cell communicating with the reaction tank through second liquid inlet means of said tank, said plurality of electrolysis cells being connected in electrical series with each other by flexible electrical connectors but otherwise not being physically connected to one another, feed conduit means connected in parallel to said first liquid inlet means of each of said reaction tanks, product conduit means connected in parallel to said first liquid outlet means of each of said reaction tanks, and brine make-up mixing tank means having first liquid inlet means connected to said product conduit means, second liquid inlet means connected to a source of fresh sodium chloride solution, third liquid inlet means connected to a source of hydrochloric acid, first liquid outlet means for removal of product sodium chlorate solution therefrom, and second liquid outlet means connected to said feed conduit means through heat exchanger means.

8. The plant of claim 7 including flow control means located in said feed conduit means for each said reaction tank.

9. The plant of claim 8 including temperature sensing means in said product conduit means for each said reaction tank and flow control means actuation means responsive to control signals from said temperature sensing means.

10. The plant of claim 7, 8 or 9 wherein said mixing tank means has baffle means upstanding from the base thereof separating the interior thereof into two zones, said first liquid inlet means of said mixing tank means and first liquid outlet means of said mixing tank means communicating with one of said zones and the second and third liquid inlet means of said mixing tank means and the second liquid outlet means of said mixing tank means communicating with the other of said zones.

11. The plant of claim 10 including first pump means located in said connection between said second liquid outlet means of said mixing tank means and said heat exchanger means for pumping liquor from said mixing tank means through said heat exchanger means and into said feed conduit means.

12. An electrolysis unit for the production of sodium chlorate by electrolysis of sodium chloride solution, comprising:

a reaction tank, first liquid inlet means for feeding sodium chloride solution to be electrolyzed to said tank, first liquid outlet means for removing sodium chlorate product solution from said tank, and a plurality of individual electrolysis cells, each cell having a plurality of anode and cathode electrodes located therein in interleaved manner to define upwardly-directed parallel electrolysis channels therebetween extending between a lower inlet of said cell communicating with the reaction tank through second liquid outlet means of said tank and an upper outlet of said cell communicating with the reaction tank through second liquid inlet means of said tank, said plurality of electrolysis cells being connected in electrical series with each other by flexible electrical connectors but otherwise not being physically connected to one another.

13. The unit of claim 12 including flow control means associated with said first liquid inlet means to control the flow of sodium chloride solution to said reaction tank.

14. The unit of claim 13 including temperature sensing means associated with said first liquid outlet means for sensing the temperature of removed product sodium chlorate solution, and flow control means actuating means responsive to predetermined signals from said temperature sensing means.

15. The unit of claim 12, 13 or 14, wherein said conduits extending between said reaction tank and each electrolysis cell are provided as a plurality of segments electrically insulated from each other.

16. A cell box for the electrolysis of sodium chloride solution to form sodium chlorate, comprising a cathode backing plate constructed of mild steel and constituting one side wall of said cell box, an anode backing plate constructed of titanium and located parallel to said cathode backing plate, said anode backing plate constituting a second side wall of said cell box, a plurality of parallel, thin cathode electrode sheets constructed of mild steel and welded in respective parallel grooves formed in said cathode backing plate, said plurality of cathode sheets extending from said cathode backing plate towards said anode backing plate, the member of said cathode sheets each side of said cathode backing plate constituting one of the other side walls of said cell box, a plurality of parallel, thin anode electrode sheets constructed of titanium and having an electro-conductive surface thereon and welded in respective parallel grooves formed in said anode backing plate, said plurality of anode sheets extending from said anode backing plate towards said cathode backing plate in interleaved relationship with said cathode sheets to define a plurality of electrolysis channels therebetween, , frame means constructed of mild steel and surrounding the outer periphery of said side wall-forming members of said plurality of cathode sheets to enclose the same within said box, said frame means having portions welded to said cathode backing plate and other portions connected to said anode backing plate in electrically-insulating relationship therewith, inlet means constituting one end closure of said cell box constructed of mild steel and welded to yet other portions of said frame means and to said cathode backing plate, said inlet means being located at one end of and in uninterrupted flow relationship with said plurality of electrolysis channels, and outlet means constituting the other end closure of said cell box constructed of mild steel and welded to additional portions of said frame means and said cathode backing plate, said inlet means being located at the other end of and in uninterrupted flow relationship with said plurality of electrolysis channels.

17. The cell box of claim 16 wherein each said electrode sheet is positively spaced from adjacent electrode sheets by electrically insulating spacer elements mounted on the respective sheets.

18. The cell box of claim 16 wherein each of said anode backing plate and cathode backing plate has a sheet of copper or aluminum explosively bonded to the face opposite to said grooves therein.

19. The cell box of claim 16, 17 or 18 wherein said electrode plates each have a thickness of about 1/16 to about ⅛ inch and said electrodes are spaced to define electrolysis channels having a width of about 1/16 to about ⅛ inch.

* * * * *